US006226871B1

(12) United States Patent
Eichhorn et al.

(10) Patent No.: US 6,226,871 B1
(45) Date of Patent: May 8, 2001

(54) DRY SHAVING APPARATUS

(75) Inventors: Reinhold Eichhorn, Idstein; Michael Harms, Oberursel; Sebastian Hottenrott, Frankfurt; Peter Junk, Schmitten; Michael Odemer, Frankfurt; Jürgen Wolf, Kriftel; Roland Ullmann, Offenbach, all of (DE)

(73) Assignee: Braun GmbH, Frankfurt am Main (DE)

( * ) Notice: Subject to any disclaimer, the term of this patent is extended or adjusted under 35 U.S.C. 154(b) by 0 days.

(21) Appl. No.: 09/136,092

(22) Filed: Aug. 18, 1998

(30) Foreign Application Priority Data

Aug. 23, 1997 (DE) ..... 197 36 776

(51) Int. Cl.[7] ..... B26B 19/02
(52) U.S. Cl. ..... 30/43.92; 30/43.9; 30/346.51
(58) Field of Search ..... 30/43.7, 43.8, 30/43.9, 43.92, 43.91

(56) References Cited

U.S. PATENT DOCUMENTS 2,339,677 1/1944 Burns .
3,925,889 * 12/1975 Albert ..... 30/43.8
4,115,920 9/1978 Ascoli .

FOREIGN PATENT DOCUMENTS 29 04 300 8/1979 (DE) .
17 11 665 U 9/1995 (DE) .

* cited by examiner

*Primary Examiner*—Lee Young
*Assistant Examiner*—Rick Kiltae Chang
(74) *Attorney, Agent, or Firm*—Fish & Richardson P.C.

(57) ABSTRACT

The invention is directed to a dry shaving apparatus with a housing (1) in which an electric drive mechanism (2) is provided having a drive element (3) for the transmission of a driving motion to at least one reciprocatory cutting element (4), and with at least one shaving head (6) oscillating in a horizontal direction and formed by a shaving head frame (7, 55) in which at least two cooperating cutting elements (4, 5) are provided, wherein the electric drive mechanism (2) is mounted for oscillation in the housing (1) and is adapted to be set in oscillation by the inner forces necessarily occurring in operation of the dry shaving apparatus, and wherein the oscillatory motions of the electric drive mechanism (2) are transmitted to the shaving head (6) in order to set said shaving head in oscillation as well.

52 Claims, 6 Drawing Sheets

DRY SHAVING APPARATUS

This invention relates to a dry shaving apparatus of the type indicated in the prior-art portion of the main claim.

A dry shaving apparatus of the type initially referred to is known from U.S. Pat. No. 2,339,677. The shaving head formed of a shaving head frame and an outer cutter and an inner cutter is arranged on an upper housing surface of a housing for reciprocating movement transverse to the direction of movement of an inner cutter driven to oscillate in the longitudinal direction. To transmit the driving motion to the inner cutter on the one hand and to the shaving head on the other hand, a double eccentric device is provided on the rotary shaft of an electric motor fixedly disposed in the housing. The masses comprised of shaving head, inner cutter and double eccentric device which are driven for reciprocating movement in different directions by driving elements produce excessive vibrations perceivable to the user because of the development of loud noise in addition to causing handling discomfort.

A dry shaving apparatus of the type referred to in the foregoing is also known from DE-GM 1 711 665. In all embodiments of this known printed specification, the drive element of the electric drive mechanism is linked, likewise through transmission elements such as a gear mechanism or a double eccentric device or a double-armed lever, to both the inner cutter and the shaving head equipped with an outer cutter, in order to set the inner cutter and, in addition, the complete shaving head in motion. Considering the masses to be set in motion by the electric drive mechanism of this specification, which include the transmission elements and the inner cutter and, in addition, the complete shaving head assembly comprised of shaving head frame, outer cutter and inner cutter, the electric motor is required to deliver an increased power output which needs to be taken into account correspondingly in the design of the dry shaving apparatus. The masses needing to be accelerated in different directions due to the oscillations and to be decelerated as well, transmit oscillation couples to the housing of the dry shaving apparatus through the electric drive mechanism secured to the housing. This effect is noticeable on the housing in the form of unpleasant vibrations and loud noise under load.

From DE 3 631 120 A1 it is known to use eccentric balance weights to dynamically balance in a dry shaving apparatus the masses such as eccentric device, oscillatory bridge structure with coupling element as well as inner cutter, which are driven to reciprocate by an electric drive mechanism, that is, an electric motor, in order to suppress undesired vibrations. These balance weights which are associated with the electric drive mechanism necessarily require an increased power output of the electric drive mechanism, resulting directly in increased cost of the electric drive mechanism and, in cases where a dry shaving apparatus is equipped with rechargeable storage cells, in an increased consumption of stored energy and hence a reduced number of shaves per charge of the storage cells.

It is an object of the present invention to improve upon a dry shaving apparatus of the type identified in the foregoing.

According to the present invention, this object is accomplished in a dry shaving apparatus of the type initially referred to by the features indicated in the main claim.

This approach of the present invention affords a plurality of advantages. When the electric drive mechanism is started, the electric drive mechanism is excited to oscillate at least in opposition to the direction of movement of one or, where applicable, several cutting elements by the masses set in motion by the drive element and also by the friction occurring between the cutting elements provided. Because according to the present invention the electric drive mechanism is mounted for oscillation, this oscillating excitation, which in the hitherto conventional, standard rigid fastening of an electric drive mechanism to the shaver housing is transmitted from the electric drive mechanism to the shaver housing where it consequently produces unpleasant vibration and loud noise, rather than being transmitted to the housing, remains initially with the electric drive mechanism, causing it to oscillate about at least one axis. The electric drive mechanism hence follows the oscillatory motions forced upon it without significant effect on the housing of the dry shaving apparatus. This approach effects first a material reduction of housing vibration and noise under load that is derivable therefrom. According to the present invention, these oscillatory motions of the electric drive mechanism are utilized advantageously to set the shaving head of the dry shaving apparatus in oscillation. The oscillation of the shaving head and hence the cutting element fixed in the shaving head produces a relative motion between the skin and the cutting element. In consequence, tips of hair that are located in close proximity to the cutting element and threadedly engage therebetween only sparingly in the absence of oscillation are then in a position to penetrate the cutting openings of the cutting element in major quantities. In addition, the oscillation of the shaving head operates to lengthen the effective hair entrance openings in the cutting element in the direction of oscillation. The threaded hair is entrained by the cutting element configured as inner cutter, the cut being performed against the edge of the hair entrance opening in the cutting element configured as outer cutter. As the shaving head executes an oscillatory motion in the directions of movement A and B, the outer cutter moves against the inner cutter, thereby shortening during the cutting operation the length of displacement of a hair that has penetrated the hair entrance opening, whereby the hair is cut to a shorter length. The cutting performance of the dry shaving apparatus is thus significantly improved. Moreover, on account of the high oscillation frequency of the shaving head, a reduced sliding friction of the cutting element becomes effective on the skin.

An essential advantage of the present invention resides in that the oscillating excitation originating from the movable masses, rather than being transmitted to the housing of the dry shaving apparatus as is known from DE-GM 1 711 665, is transmitted, via the oscillatory mounting of the electric drive mechanism, to the movable shaving head. Hence the energy of the oscillating excitation is routed from a location in the housing where disturbing effects occur to a location where this energy can be put to use in advantageous manner. For lack of linkage of its drive element with the oscillatory shaving head, the electric drive mechanism is thus not required to supply driving power to this shaving head.

In a further configuration of this invention, provision is made for at least the shaving head and the electric drive mechanism to be mounted for oscillation as an oscillating mass about at least one common axis of oscillation.

To compute the position of the axis of oscillation for the electric drive mechanism in the housing, allowance must be made for the fact that the oscillating mass is formed by incorporating the oscillating mass of the electric drive mechanism as well as all components adapted to be set in oscillation by the oscillatory motions of the electric drive mechanism, such components including, for example, the shaving head, support arms, the bearing cage, the universal joint frame, the oscillatory frame, the supporting frame, the spring element and the oscillatory bridge structure for a cutting unit and/or by fitting additional oscillating masses.

In an advantageous embodiment of the present invention, the electric drive mechanism with the components adapted to be set in oscillation is mounted for oscillation about a first axis of oscillation which extends transversely to the directions of movement of the drivable cutting element.

A further advantageous embodiment of the present invention is characterized in that the electric drive mechanism with the components adapted to be set in oscillation is mounted for oscillation about a second axis of oscillation which extends parallel to the directions of movement of the drivable cutting element.

In a preferred embodiment of the present invention, provision is made for the shaving head and the electric drive mechanism to be mounted for oscillation in the housing about the first and the second axis of oscillation by means of a cardanic suspension. The arrangement of a second axis of oscillation intersecting the first axis of oscillation at right angles, which arrangement is derivable from the cardanic suspension of the electric drive mechanism and the shaving head in the housing of the dry shaving apparatus, makes it possible to keep the reaction forces occurring about the first and the second axis of oscillation due to dynamic processes away from the housing, in addition to enabling their utilization for oscillatory motions of the shaving head in both the directions of movement A and B and the directions of movement C and D.

In an embodiment of the present invention, the oscillating element is adapted to be linked to the oscillatory supporting frame through the bearing cage or a housing portion. In a further aspect of this embodiment, provision is made for an engaging device for linking the bearing cage or the housing portion to the supporting frame.

In a preferred embodiment of the present invention, the electric drive mechanism is mounted for oscillation about an axis of oscillation.

A preferred embodiment of the present invention is characterized in that the shaving head is mounted for oscillation in the housing by means of at least one oscillating element.

In a preferred embodiment of the present invention, the oscillating element is formed by support arms having joints.

In another embodiment of the present invention, the oscillating element is formed by a housing portion.

According to a simple embodiment of the present invention affording low-cost manufacture, the oscillating element is formed by a universal joint frame mounted for oscillation, a bearing cage mounted for oscillation in the universal joint frame, an oscillatory frame, and support arms.

A substantial improvement of the cutting performance of the cutting elements and an appreciable reduction in vibration of the housing of the dry shaving apparatus are obtainable by arranging the axis of oscillation so as to extend through the center of impact of the oscillating mass. The center of impact of the oscillating mass is the location about which the motor would oscillate if a drive unit—comprised of electric drive mechanism and driven elements—operating at rated speed were able to oscillate freely. At this location the bearing forces to be exerted for the oscillating mass, which in this case is the drive unit, reach their minimum, causing undesired housing vibration to be reduced to a minimum.

According to another embodiment of the present invention, the axis of oscillation is provided at a distance to the center of impact of the oscillating mass. With such an approach it is possible to vary, for example, the extent of the oscillation amplitude of the electric drive mechanism and hence of the shaving head linked thereto in simple manner.

In a preferred embodiment of the present invention, the shaving head is drivable by the oscillatory motions of the electric drive mechanism in the directions of movement A and B of the drivable cutting element. In a further aspect of this embodiment, provision is made for the shaving head to be driven by the electric drive mechanism so as to oscillate in opposition to the reciprocating movements of the cutting element. This approach results in an improved cutting performance by reducing the hair displacement travel in the hair entrance openings of the outer cutter.

According to another advantageous embodiment of the present invention, the shaving head is drivable in the directions of movement C and D by the oscillatory motions of the electric drive mechanism, transversely to the directions of movement A and B of the drivable cutting element.

According to the present invention, the cutting performance of the cutting elements is improved by providing for different oscillation amplitudes for the shaving head and the movable cutting element. This approach ensures, for example, an optimum configuration and adaptation of movable cutting elements relative to stationary cutting elements, incorporating the wide variety of geometries of hair entrance openings in cutting elements operating as outer cutter. The invention further affords a substantial advantage in that the oscillation amplitudes of the shaving head and/or the cutting element are variable. The respective oscillation amplitudes can be varied, for example, by varying the masses to be set in oscillation, or by relocating the axis of oscillation away from the center of impact of the oscillating mass.

In a preferred embodiment of the present invention, provision is made for the oscillation amplitude to be determinable by the cutting element and for the oscillation amplitude of the shaving head to be adjustable thereto. This approach ensures an optimum relative adjustment of cooperating cutting elements. Tests performed on a dry shaving apparatus of the present invention revealed that the reciprocatory travel of the shaving head in the directions of movement A and B and in the directions of movement C and D should be provided in a range from 0.05 mm to 1 mm. In a preferred embodiment of the present invention, the reciprocatory travel of the shaving head should be in a range from 0.15 mm to 0.5 mm. An optimum magnitude of the reciprocatory travel of the shaving head for a particular type of dry shaving apparatus should be determined on a case-by-case basis, taking into account the respective configuration of cooperating cutting elements, in particular the hair entrance opening geometries.

In another aspect of the present invention, the electric drive mechanism is mounted for oscillation about the axis of oscillation by means of pivot bearings. These pivot bearings operate to largely decouple the electric drive mechanism from the unavoidable housing vibration in addition to ensuring at the same time that this vibration energy is utilized to advantage to cause an oscillatory motion of the shaving head. By means of these low-friction pivot bearings the electric drive mechanism is mounted for oscillation in the housing of the dry shaving apparatus, such that it follows the oscillation forced upon the electric drive mechanism without appreciable reaction on the housing.

An embodiment of the present invention affording ease and economy of manufacture is characterized in that the pivot bearing is provided on at least one support element of the housing and on a housing portion of the electric drive mechanism.

In another advantageous embodiment of the present invention, provision is made for the housing portion of the electric drive mechanism to be securable in a bearing cage.

In another advantageous embodiment of the present invention, the one pivot bearing is provided on a bearing cage of the electric drive mechanism and on the universal joint frame, and the other pivot bearing is provided on the universal joint frame and on a support element of the housing.

In a preferred embodiment of the present invention, the pivot bearing for the electric drive mechanism is configured as a cone bearing.

To make sure that the shaving head performs an oscillatory motion in the directions of movement A and B and/or C and D, a preferred embodiment of the present invention makes provision for at least one support arm for the shaving head. In a further aspect of this embodiment, at least two joints are provided on the support arm.

In an advantageous embodiment of the present invention, the support arm is configured as a spring element. A low-cost embodiment of a spring element is characterized in that the spring element is formed by a leaf spring.

For the purpose of transmitting the oscillatory motion forced upon the electric drive mechanism to the shaving head, an embodiment of the present invention makes provision for at least one support arm to be adapted to be linked to the electric drive mechanism through an oscillating element having joints. These joints may be formed, for example, by joint bolts—not shown—slidably received in bores. According to an embodiment affording low cost manufacture of joints, at least one joint is configured as a film hinge.

In an advantageous embodiment of the present invention, provision is made for the support arm to be linked through one joint to at least one support element, and through another joint to the shaving head frame of the shaving head, such as to be capable of oscillating in the directions of movement A and B. This embodiment corresponds to a mechanism referred to as a four-bar mechanism. In another embodiment of the present invention, the joint for the support arm is provided in the housing at the housing end opposite the shaving head. This embodiment makes use of the available length of the housing of the dry shaving apparatus to accommodate the length of the support arm, whereby the vertical component derivable from the oscillatory motion is reduced in magnitude to a minimum, so that a nearly linear oscillatory motion is accomplished in the directions of movement A and B of the shaving head.

A further relatively simple embodiment of the present invention is characterized in that the support arm is linked for oscillation to at least one support element at the one end and to a supporting frame carrying the shaving head at the other end. In this embodiment, the supporting frame is adapted to be linked to the electric drive mechanism directly, and this through a housing portion of the electric drive mechanism or through a bearing cage encompassing it. In a further aspect of this embodiment, provision is made for the electric drive mechanism to be adapted to be linked to the supporting frame through a housing portion and an engaging device. A simple and low cost embodiment for the transmission of motion from the electric drive mechanism or a housing portion of the electric drive mechanism to the supporting frame is characterized in that the engaging device is formed of a slot and a pin engageable in said slot.

In another advantageous embodiment of the present invention, the engaging device is formed of a ball-and-socket joint. The ball-and-socket joint which is provided at a distance to the first and the second axis of oscillation in the supporting frame and the bearing cage ensures the transmission of the rotations produced in the electric drive mechanism in the axes of oscillation to the supporting frame and consequently to the shaving head.

In a further embodiment of the present invention, provision is made for the drive element of the electric drive mechanism to be adapted to be linked through an oscillatory bridge structure to a cutting element of the shaving head. In a still further embodiment of the present invention, the drive element of the electric drive mechanism is adapted to be linked through at least one eccentric device to a cutting element of the shaving head. Another embodiment of the present invention is characterized in that the drive element of the electric drive mechanism is adapted to be linked through an eccentric device configured as a double eccentric device to cutting elements of different configurations. Cutting elements of different configurations are understood to mean the cutting elements of a short-hair cutter—see FIG. 1—and the cutting elements of a, long-hair trimmer as well. The long-hair trimmer may be provided on or in the housing of the dry shaving apparatus or in a shaving head in known manner (not shown).

In a further aspect of the present invention, provision is made for the eccentric member of a double eccentric device to be adapted to be linked to a cutting element of a long-hair trimmer through an oscillatory bridge structure. In a preferred embodiment off the present invention, the electric drive mechanism is configured as a direct-current motor having a drive element provided for rotation. An alternative embodiment is characterized in that the electric drive mechanism is configured as a rocking armature motor having an oscillatory drive element.

In another embodiment of the present invention, provision is made for the electric drive mechanism and the shaving head to be held in a mid-position by means of a spring element. In a further aspect of this embodiment, the spring elements bear with one end against the electric drive mechanism and with their other end against the housing.

Embodiments of the present invention will be described in more detail in the following with reference to the accompanying drawings. In the drawings, FIG. 1 is a longitudinal sectional view of the upper part of a housing of a dry shaving apparatus, with an electric drive mechanism mounted therein for oscillation, and with a shaving head adapted to be set in oscillation through support arms;

Figure 1:
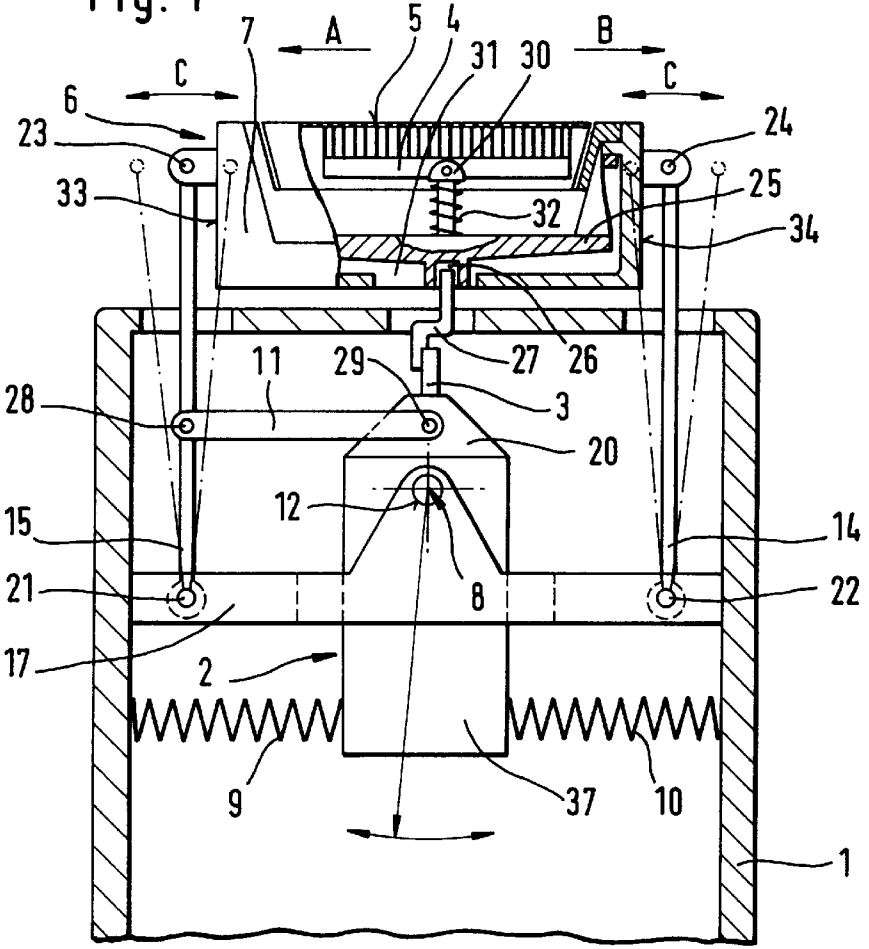

FIG. 1 shows a dry shaving apparatus with a housing 1 in which an electric drive mechanism 2 is provided having a drive element 3 for the transmission of a driving motion to at least one cutting element 4 adapted to reciprocate in the directions of movement A and B, and with a movably mounted shaving head 6 formed by a shaving head frame 7 in which two cooperating cutting elements 4 and 5 are provided. Arranged in the housing 1 are two support elements 16 and 17—see FIG. 2—on which the electric drive mechanism 2 is mounted for oscillation about a first axis of oscillation 8 transverse to the directions of movement A and B of the cutting element 4 by means of pivot bearings 12 and 13. The pivot bearings 12 and 13 are configured as cone bearings.

In addition to the shaving head frame 7 with its cutting elements 4 and 5, the shaving head 6 accommodates further components as, for example, an oscillatory bridge structure 25 having a coupling element 30 for coupling engagement with the cutting element 4, with the requisite contact pressure of the cutting element 4 against the cutting element 5 being ensured by at least one spring element 32 disposed between the oscillatory bridge structure 25 and the cutting element 4. Serving to transmit the driving motion from the drive element 3 to the oscillatory bridge structure 25 is an eccentric device 27 having its one end secured to the drive element 3 while its other end engages with a pin in a dovetail-type slot 26 provided on the oscillatory bridge structure 25.

Pivotally mounted on the support elements 16 and 17 by means of joints 21 and 22 are two support arms 14 and 15. The ends of the support arms 14 and 15 remote from the joints 21 and 22 are connected to end walls 33 and 34, respectively, of the shaving head frame 7 by means of joints 23 and 24, respectively, in such fashion that an oscillatory to-and-fro motion of the shaving head 6 in the directions of movement A and B of the cutting element 4 is ensured. The oscillatory motion of the electric drive mechanism 2 is transmitted to the shaving head 6 by means of an oscillating element 11 having its one end linked to the support arm 15 through a joint 28 and its other end to a housing portion 20 of the electric drive mechanism 2 through a joint 29. At the end of the electric drive mechanism 2 remote from the shaving head 6, two spring elements 9 and 10 bearing against the housing 1 and acting upon the electric drive mechanism 2 are provided, said spring elements operating to hold the electric drive mechanism 2 in a mid-position when deactivated.

Figure 5:
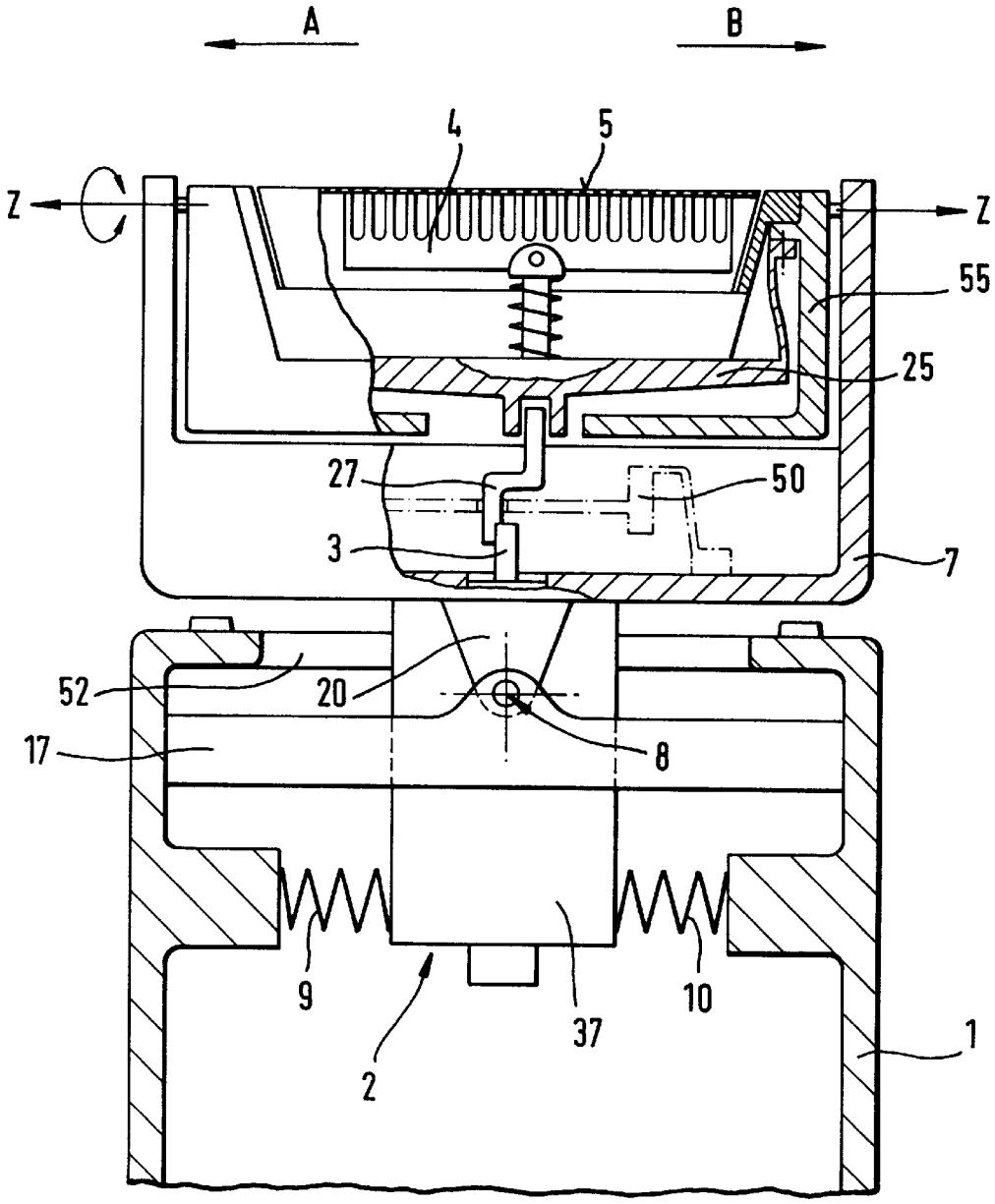
FIG. 5 is a sectional view of the upper part of a housing, showing an electric drive mechanism mounted for oscillation in the housing and linked to the shaving head mounted for oscillation, in which two oscillatory bridge structures are provided.
Figure 6:
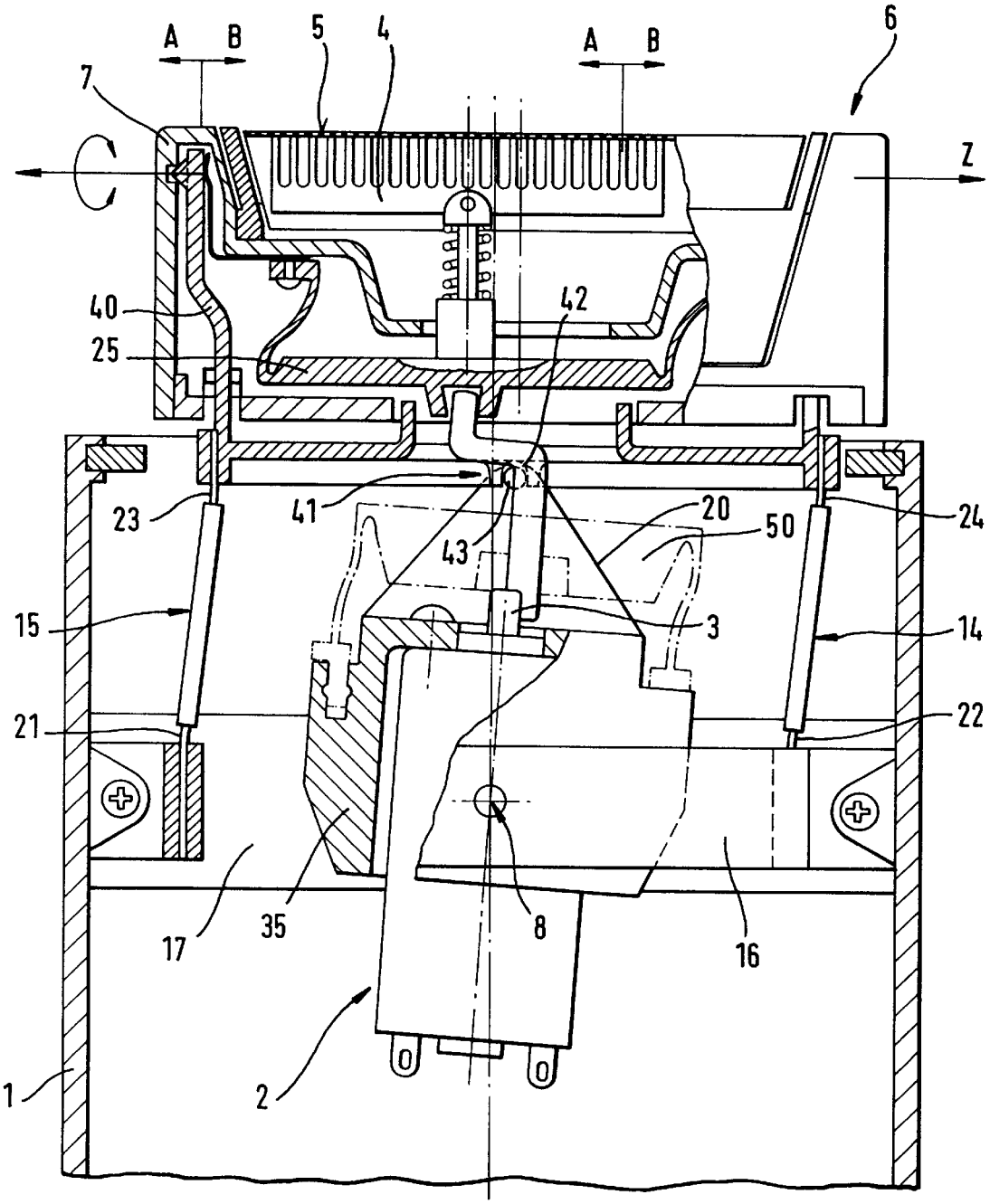
FIG. 6 is a sectional view of the upper part of the housing of a dry shaving apparatus, showing an electric drive mechanism mounted for oscillation in the housing, a double eccentric device for operating two oscillatory bridge structures, and a shaving head mounted for oscillation in the directions of movement A and B in addition to being mounted for pivotal movement about the pivot axis Z.
Figure 7:
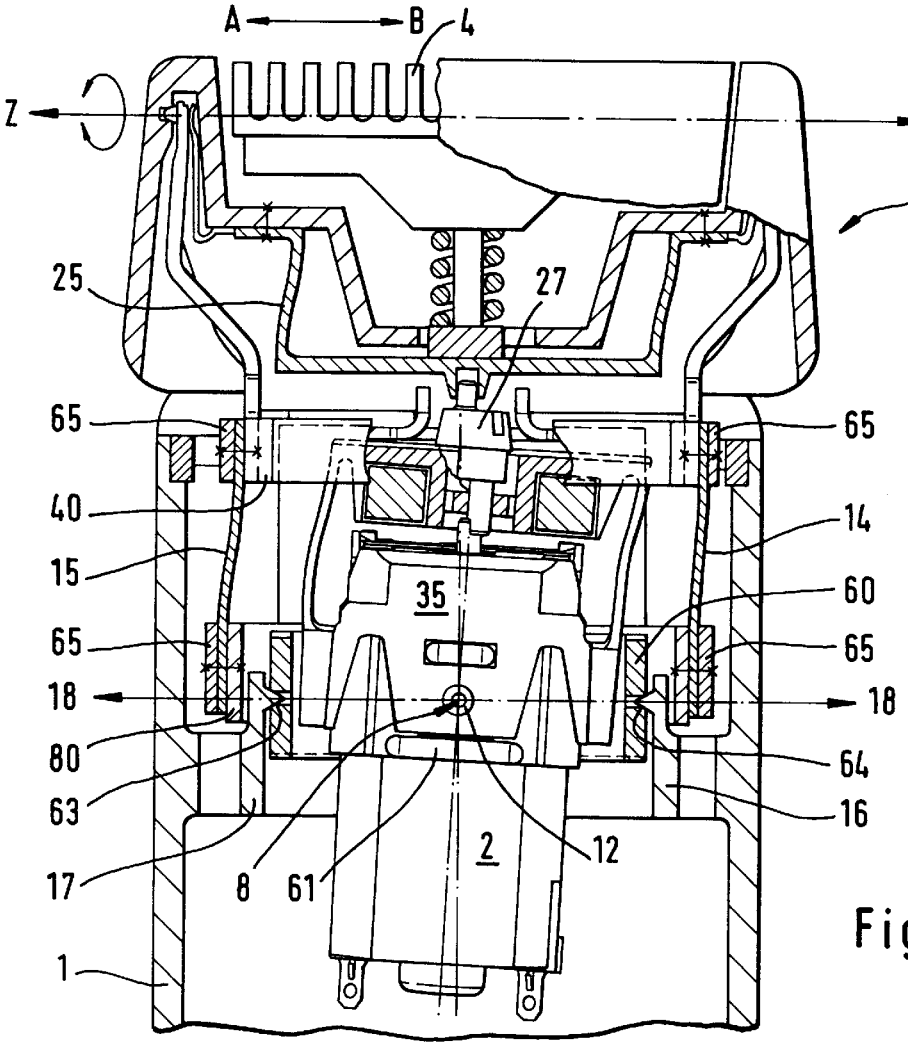
FIG. 7 is a sectional view of part of the housing and the shaving head of a dry shaving apparatus, with a cardanic suspension of the electric drive mechanism.
Figure 8:
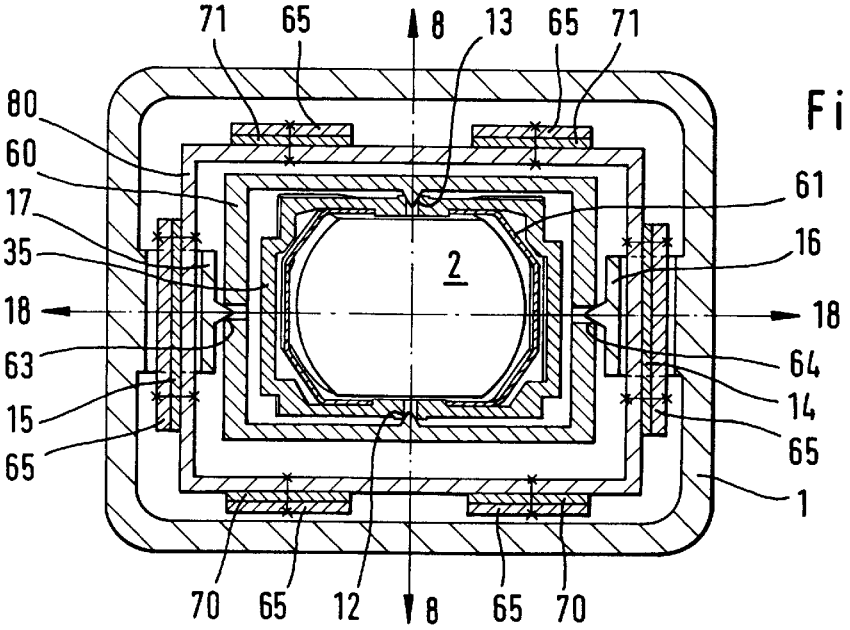
FIG. 8 is a sectional view of the housing of a dry shaving apparatus, showing the components of the cardanic suspension of the electric drive mechanism.
Figure 9:
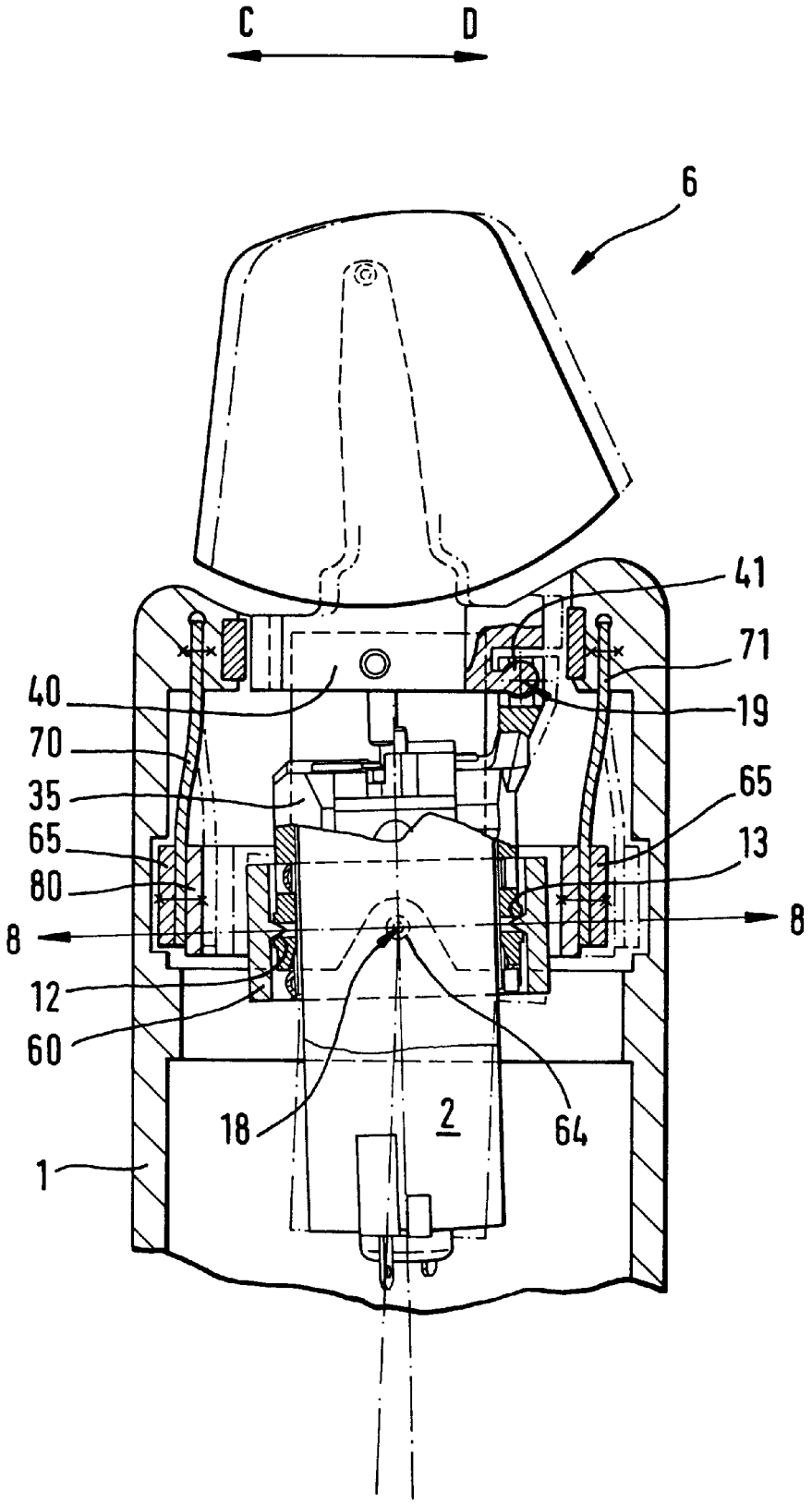
FIG. 9 is a side view of a shaving head and a sectional view of part of the housing.

The first axis of oscillation 8 of FIGS. 1 to 9 and the second axis of oscillation 18 of FIGS. 7 to 9 passes through the center of impact of all oscillating masses adapted to be set in oscillation when the electric drive mechanism 2 is started, their moments of inertia being taken into account. These oscillating masses and their moments of inertia differ for each dry shaving apparatus so that the position of the center of impact and hence the position of the axis of oscillation 8 and the second axis of oscillation 18 as well need to be determined for the particular type of dry shaving apparatus involved, applying physical computation methods well known to the person in the art. Starting from a calculable optimum position of the center of impact or position of the first axis of oscillation 8 and the second axis of oscillation 18 in the housing 1 of a dry shaving apparatus, bearing arrangements of the first and/or second axis of oscillation 8, 18 that deviate therefrom are possible as well. Due to numerous influencing variables as, for example, the magnitude of the mass involved and its moment of inertia, imbalance of oscillating masses, friction of cooperating cutting elements, the limits of permissible deviations from the optimum center of impact can be determined and fixed for the particular embodiment only by practical tests in order to then manufacture this particular type of shaving apparatus in series.

Figure 2:
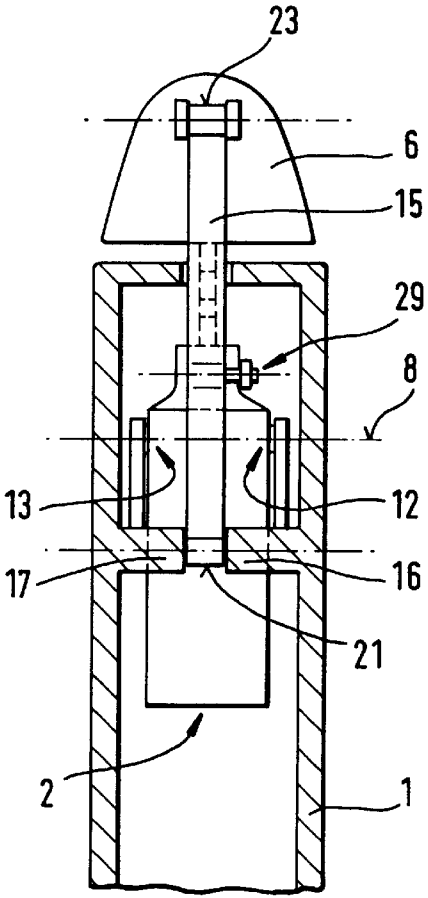
FIG. 2 is a side view of the shaving head of FIG. 1, the housing being shown in longitudinal sectional view.

FIG. 2 shows a longitudinal sectional view of the housing 1 of the dry shaving apparatus of FIG. 1, such that the joints 21 and 23 provided on the support arm 15 can be viewed. Parallel to the respective axial directions of the pivot bearings provided, the joints 21 and 23 include bearing trunnions and bearing bores which are disposed in the support elements 16 and 17 and on the end walls 33, 34 of the shaving head 6. Provided on the support elements 16 and 17 is a respective support wall extending in vertical direction for pivotal connection of the electric drive mechanism 2 by means of the pivot bearings 12 and 13 configured as cone bearings.

When the dry shaving apparatus is started by turning on the electric drive mechanism 2, the rotary motion of the drive element 3 of the electric motor is converted, via the eccentric device 27 and the slot 26 provided in the oscillatory bridge structure 25, into an oscillatory motion of the oscillatory bridge structure 25, this to-and-fro motion of the oscillatory bridge structure 25 in the directions of movement A and B being then transmitted through the coupling element 30 to the cutting element 4 acting as inner cutter. The cutting element 4 slides along the cutting element 5 configured as a shaving foil in order to cut off hairs that have entered holes and/or slots in the shaving foil. At the same time, the electric drive mechanism 2 experiences an oscillating excitation in opposition to the respective direction of movement of the cutting element 4 sliding along the cutting element 5. Due to the pivotal mounting of the electric drive mechanism 2, the electric drive mechanism follows the oscillation about the axis of oscillation 8 forced upon it, with the extent of the oscillation amplitude being lower than the extent of the respective oscillation amplitude of the reciprocating cutting element 4 because of, inter alia, the magnitude and inertia of the aggregate of the masses adapted to be set in oscillation. The oscillation amplitude of the electric drive mechanism 2 is transmitted through the oscillating element 11 to the support arm 15 and from this arm to the shaving head 6, hence setting the shaving head 6 with all the components provided therein in an oscillatory motion going to-and-fro in the directions of movement A and B. Accordingly, the shaving head 6 moves in relative opposite directions to the simultaneously moving cutting element 4. The length of travel of the oscillating shaving head 6 is substantially shorter than the length of travel of the cutting element 4.

Figure 4:
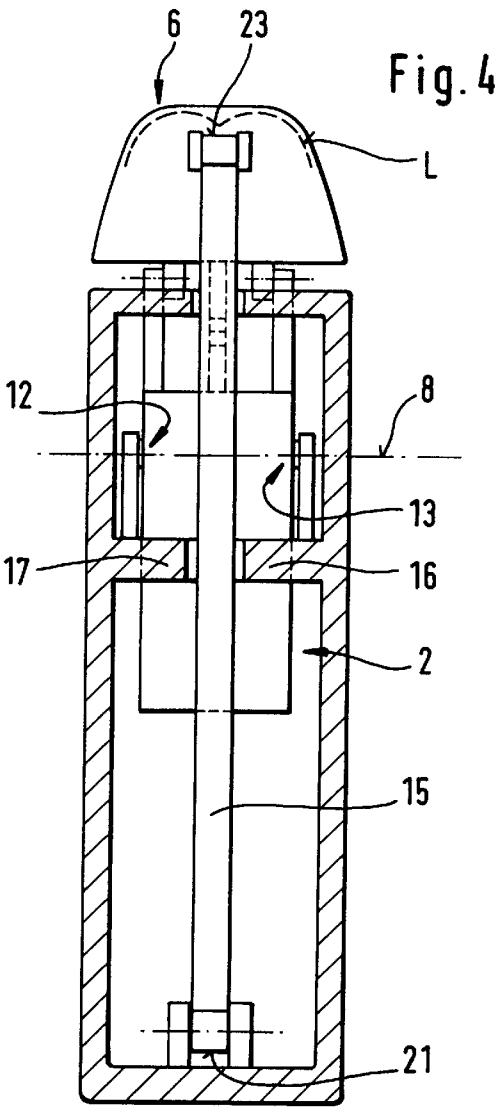
FIG. 4 is a side view of the dry shaving apparatus of FIG. 3, with a shaving head assembly comprised of two shaving heads, the housing being shown in longitudinal sectional view, and with a support arm pivotally mounted in the housing and on the shaving head.
Figure 3:
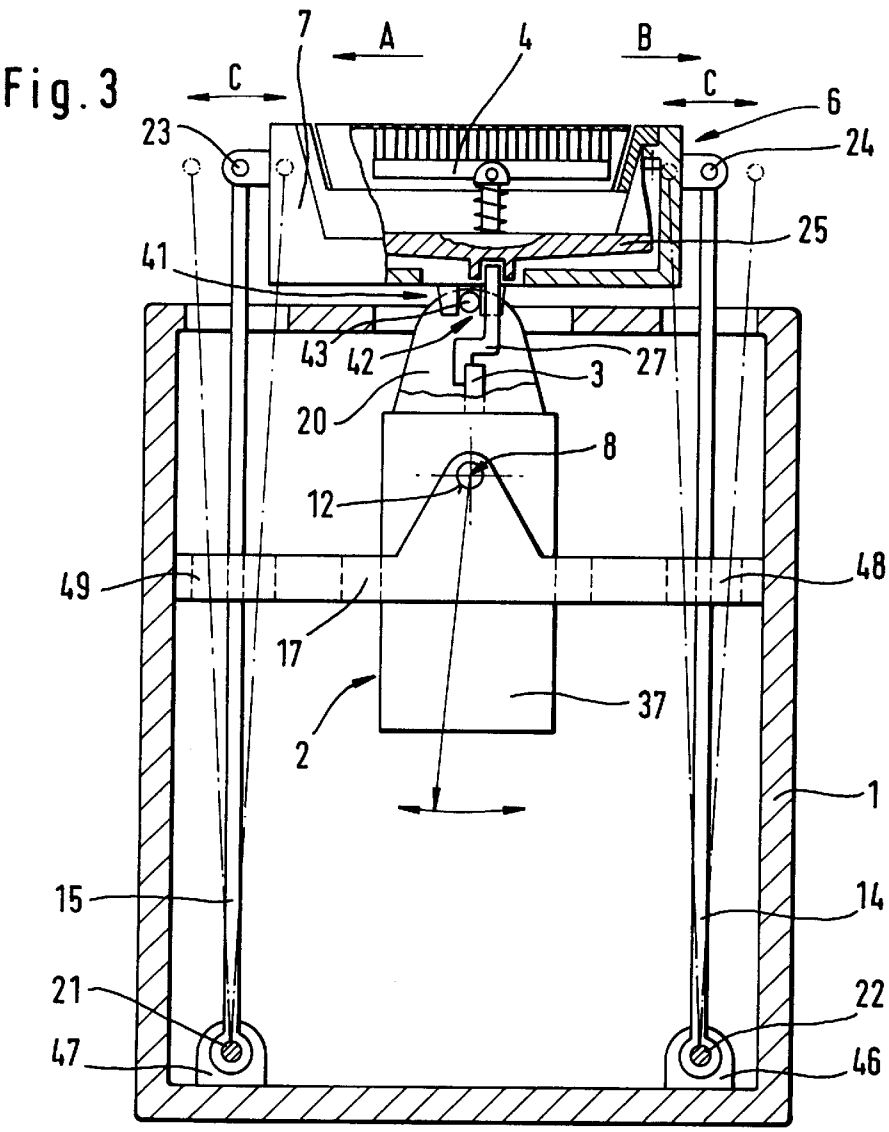
FIG. 3 is a longitudinal sectional view of the housing of a dry shaving apparatus and a partial sectional view of the shaving head adapted to be set in oscillation, the shaving head being driven to oscillate by a housing portion of the electric drive mechanism.

FIG. 3 shows a section through the housing 1 of a dry shaving apparatus, with an electric drive mechanism 2 mounted for oscillation about a first axis of oscillation 8 on support elements 16, 17 by means of pivot bearings 12, 13—see FIG. 4, the mechanism's drive element 3 being connected through an eccentric device 27 to an oscillatory bridge structure 25 provided in the shaving head 6 for the purpose of transmitting a reciprocating driving motion to a cutting element 4 acting as an inner cutter.

The shaving head 6 reciprocatory in the directions of movement A and B is a component part of a four-bar mechanism having links configured as support arms 14, 15 which are pivotally mounted, by means of joints 21, 22, on support elements 46, 47 provided in the housing 1 at the end of the housing 1 remote from the shaving head 6. The support arms 14, 15 pivotally carried in the joints 21, 22 are passed through openings 48, 49 provided in the support elements 16, 17 and are pivotally connected by means of joints 23, 24 to the end walls 33, 34 of the shaving head 6. The electric drive mechanism 2 includes two housing portions 20, 37. Provided on the housing portion 20 is a pin 43 which is in sliding engagement with a slot 42 provided on the shaving head frame 7 in order to transmit the oscillating movement of the electric drive mechanism 2 through this engaging device 41 to the shaving head 6. By reason of the very large overall length of the support arms 14 and 15, which length is determined by the pivotal connection to the shaving head frame 7 of the shaving head 6 at the one end and the support elements 46, 47 on the bottom of the housing 1 at the other end, the oscillation amplitude's vertical component exerted radially about the joints 21, 22 is relatively small, so that a nearly linear motion of the shaving head 6 in the directions of movement A and B can be assumed.

FIG. 4 shows a side view of the dry shaving apparatus of FIG. 3 with a longitudinal section through the housing 1, such that the joints 21, 23 provided on the support arm 15 are visible. Parallel to the respective axial directions of the pivot bearings provided, the joints 21, 23 have bearing trunnions and bearing bores, not shown, which are formed on a bottom wall of the housing 1 and are provided on the end walls 33, 34 of the shaving head 6. Provided on the support elements 16, 17 is a respective support wall extending vertically to the shaving head 6 for pivotally connecting the electric drive mechanism 2 oscillatory about an axis of oscillation 8 by means of the pivot bearings 12, 13 configured as cone bearings.

The shaving head 6 carried by the support arms 14, 15—see FIG. 3—is configured, for example, as a twin shaving head whose cutting elements 5 provided as outer cutters are shown symbolically by a broken line L. It will be understood that the design of the shaving head 6 is not limited to the arrangement of one or two cutting elements 4, 5 within its shaving head frame 7. Several cutter arrangements may well be provided in the shaving head frame 7 of the shaving head 6, and the associated cutting elements may be of different configurations to suit a particular cutting function. For example, the possibility exists to provide in the oscillatory shaving head 6 two cutter arrangements operating as short-hair cutters, and one cutter arrangement operating as long-hair trimmer which is fitted therebetween.

FIG. 5 shows a sectional view of the housing 1 with an opening 52 in the wall of the housing 1 opposite the shaving head frame 7. The electric drive mechanism 2 is secured to the shaving head frame 7 and is mounted on the support elements 16, 17 for oscillation about the axis of oscillation 8 by means of at least one housing portion 20 having an orientation away from the shaving head frame 7 in the direction of the support elements 16, 17 provided in the housing 1—see FIG. 4. By means of spring elements 9, 10 resting with one end against the housing portion 37 of the electric drive mechanism 2 and with their other end against inner wall portions of the housing 1, the electric drive mechanism 2 is in a mid-position when deactivated.

Provided inside the shaving head's 6 shaving head frame 7 adapted to be set in a reciprocating oscillation through the housing portion 20 when the electric drive mechanism 2 is started, is a shaving head frame 55 which is mounted for pivotal motion about a pivot axis Z and includes at least one cutter arrangement formed of cutting elements 4, 5, as well as an oscillatory bridge structure 25 for the transmission of a driving motion from a drive element 3 to the movable cutting element 4. In addition, in an area of the shaving head frame 7 remote from the cutting element 5, a further oscillatory bridge structure 50 is shown in broken lines which operates on a further cutter arrangement suitable, for example, for trimming contours. The oscillatory bridge structures 25 and 50 are driven by the eccentric device 27 configured as a double eccentric device 44 which is affixed to the rotary drive element 3 of the electric drive mechanism 2.

FIG. 6 shows the housing 1 of a dry shaving apparatus with support elements 16, 17 on which the electric drive mechanism 2 fixedly disposed in a bearing cage 35 is mounted for oscillation about a first axis of oscillation 8 by means of pivot bearings. The embodiment of FIG. 6 shows the electric drive mechanism 2 in an oscillation position achievable in operation in which the reciprocatory shaving head 6 in the direction of movement B has reached a reversal position in the direction of movement A.

The shaving head 6 is mounted on the support elements 16, 17 for oscillation in the directions of movement A and B through a supporting frame 40 and through support arms 14, 15 having joints 21, 22, 23, 24. The supporting frame 40 is of a U-shaped configuration and connected through an engaging device 41 to a housing portion 20 of the bearing cage 35 for transmitting the oscillatory motion of the electric drive mechanism 2 about the first axis of oscillation 8. The engaging device 41 is comprised of a pin 43 engaging in a slot 42, said slot 42 being formed in the base part of the U-shaped supporting frame 40 and said pin 43 being provided on the housing portion 20 of the bearing cage 35. The electric drive mechanism 2 comprises an electric motor having a drive element 3 configured as a rotary shaft to which an eccentric device 27 configured as a double eccentric device 44 is secured in order to transmit the driving motion from the drive element 3 to an oscillatory bridge structure 25 provided in the shaving head frame 7 of the shaving head 6. The oscillatory bridge structure 25 has a slot of a dovetail-type configuration in which the pin of the eccentric device 27 configured as double eccentric device 44 engages. The dovetail-type configuration of the slot ensures a wear-free transmission of the driving motion from the drive element 3 to the oscillatory bridge structure 25 because the angles of the dovetail configuration are fitted to suit the positions of oscillation of the electric drive mechanism 2 in operation.

The U-shaped supporting frame 40 ensures an optimum oscillatory motion of the shaving head 6 in the directions of movement A and B in addition to ensuring, through conically formed joints, a pivotal motion of the shaving head frame 7 with its one or more cutter arrangements formed from cutting elements 4, 5 about the pivot axis Z.

Mounted on the bearing cage 35 of the electric drive mechanism 2 is an oscillatory bridge structure 50 illustrated by broken lines. This oscillatory bridge structure 50 may be utilized for operation of a long-hair trimmer that may be fitted to an outside of the housing 1 or to an actuating switch, not shown. Similar to the oscillatory bridge structure 25 in the shaving head 6, the oscillatory bridge structure 50 may be utilized for attachment of an oscillating mass, not shown, for the purpose of varying the respective oscillating masses and hence effecting an amplitude variation.

FIGS. 7, 8 and 9 illustrate a further embodiment of a dry shaving apparatus with a shaving head 6 capable of reciprocating in the directions of movement A and B and in further directions of movement C and D.

FIG. 7 is a section through part of the dry shaving apparatus TR to show components of an oscillating system ensuring oscillatory motions in the directions of movement A and B as well as C and D. The shaving head 6 is secured to a supporting frame 40 mounted for oscillation. The supporting frame 40 is linked to an oscillatory frame 80 by means of parallel support arms 14 and 15, mounting plates 65 being provided to secure the support arms 14 and 15 to the supporting frame 40 and the oscillatory frame 80. The support arms 14 and 15 are configured, for example, as leaf springs in order to make sure that the supporting frame 40 and the shaving head 6 oscillate in the directions of movement A and B. Support arms 70 and 71 are secured to the oscillatory frame 80 by means of mounting plates 65 in a parallel and opposite relationship to each other. The support arms 70 and 71 have their opposite ends—see FIG. 9—fastened in the housing 1 of the dry shaving apparatus TR. The support arms 70 and 71 are configured, for example, as leaf springs. Provided on the inside of the housing are support elements 16 and 17 which are linked to a universal joint frame 60 by means of pivot bearings 63 and 64. The universal joint frame 60 is 5 linked through pivot bearings 12, 13—see FIG. 8—to the bearing cage 35 for oscillation, with an annular spring element 61 being biased to link the bearing cage 35 through the pivot bearings 12 and 13 to the universal joint frame 60 in clearance-free manner. The motor shaft 3 of the electric drive mechanism 2 is in driving engagement with the inner cutter 4 of the shaving head 6 through an eccentric device 27 and an oscillatory bridge structure 25, as illustrated and described by way of example with reference to the embodiments of FIG. 1 and FIG. 6.

FIG. 8 shows a section through the housing 1 of the dry shaving apparatus TR and through the support elements 16 and 17, the pivot bearings 12 and 13, the pivot bearings 63 and 64, and through the oscillatory frame 80, the universal joint frame 60, the bearing cage 35, the spring element 61 and the electric drive mechanism 2. The electric drive mechanism 2 is mounted in the housing 1 for oscillation about a first and a second axis of oscillation 8 and 18, respectively, intersecting at right angles, such that a cardanic suspension is obtained. The electric drive mechanism 2 is fixedly connected to the bearing cage 35. A first axis of oscillation 8 is formed by two pivot bearings 12, 13 in relative opposite arrangement using, for example, conical pins on the universal joint frame 60 and conical bearing bores in the bearing cage 35. Using an axially acting bias of a spring element 61 as, for example, a radially acting annular spring, it is possible to design this bearing arrangement with a permanently low clearance.

A second axis of oscillation 18—provided orthogonally to the first axis of oscillation 8—is formed by two opposite pivot bearings 63, 64, with the conical bearing trunnions provided, for example, on the support elements 16 and 17 of the housing 1 engaging within conical bearing bores in the universal joint frame 60. In the embodiment shown, the first axis of oscillation 8 and the second axis of oscillation 18 intersecting the first axis of oscillation 8 at right angles lie in a common plane. Unlike this arrangement, the first axis of oscillation 8 and the second axis of oscillation 18 may also be arranged in different planes.

The shaving head 6 of the dry shaving apparatus TR is linked to the housing 1 for oscillation, in such fashion that the shaving head 6 is in a position to move in a plane relative to the housing 1 in the directions of movement A and B and in the directions of movement C and D as well, without the distance between housing 1 and shaving head 6 measured normal to this plane varying appreciably.

In the embodiment illustrated in FIGS. 7, 8 and 9, this linear guide of the shaving head 6 is accomplished by a cross-wise arrangement of two four-bar linkages.

A first four-bar linkage—see FIG. 9—is formed by the support arms 70, 71 arranged and acting in parallel and made, for example, of spring steel, and by the oscillatory frame 80. The support arms 70 and 71 have one end thereof fixedly connected with the housing 1 as by ultrasonic welding, while their other end is secured to the oscillatory frame 80 by means of associated mounting plates 65 as by welding. This configuration enables the oscillatory frame 80 to swing to and fro relative to the housing 1 in the directions of movement C and D.

The second four-bar linkage is formed by support arms 14 and 15 arranged and acting in parallel and made, for example, of spring steel, and by the supporting frame 40 acting as coupling link. The support arms 14 and 15 have their respective ends secured by welding to the oscillatory frame 80 and to the supporting frame 40 by means of mounting plates 65. This second four-bar linkage enables a to and fro oscillating movement of the shaving head 6 in the directions of movement A and B.

A kinematic linkage of the electric drive mechanism 2 to the shaving head 6 is accomplished by means of the engaging device 41 configured as a ball-and-socket joint. For this purpose, a ball is provided on the supporting frame 40 and a socket is formed on the bearing cage 35. This ball-and-socket joint which is arranged at a distance to the first axis of oscillation 8 and the second axis of oscillation 18 operates to transmit the rotations occurring in the electric drive mechanism 2 about the first axis of oscillation 8 and the second axis of oscillation 18 to the supporting frame 40 and hence to the shaving head 6 as translations, whereby this supporting frame 40 with the shaving head 6 is in a position to execute oscillating movements in the directions of movement A and B, as well as C and D.

What is claimed is:

1. A dry shaving apparatus comprising:

a housing having a longitudinal axis;

a shaving head on the housing and mounted so as to permit the shaving head to oscillate in a first direction that is transverse to the longitudinal axis of the housing, said shaving head including a shaving head frame and two cooperating cutting elements within the shaving head frame, wherein at least one of said two cooperating cutting elements is a reciprocating cutting element;

an electric drive mechanism mounted in the housing so as to permit oscillatory motions of the electric drive mechanism relative to the housing, said drive mechanism having a drive element for supplying a driving motion to said reciprocating cutting element, wherein said drive mechanism is caused to oscillate within the housing by supplying driving motion through the drive element to said reciprocating cutting element, and wherein the oscillatory motions of the electric drive mechanism are transmitted to the shaving head causing said shaving head to oscillate relative to the housing.

2. The dry shaving apparatus as claimed in claim 1, wherein the shaving head and the electric drive mechanism are mounted for oscillation as an oscillating mass about a common first axis of oscillation.

3. The dry shaving apparatus as claimed in claim 2, wherein the oscillating mass is formed by incorporating an oscillating mass of the electric drive mechanism as well as other components adapted to be set in oscillation by the oscillatory motions of the electric drive mechanism.

4. The dry shaving apparatus as claimed in claim 2, wherein the first axis of oscillation extends transversely to a direction of movement of the reciprocating cutting element.

5. The dry shaving apparatus as claimed in claim 2, wherein the first axis of oscillation extends parallel to a direction of movement of the reciprocating cutting element.

6. The dry shaving apparatus as claimed in claim 2, wherein the oscillating mass comprises pivot bearings and wherein the electric drive mechanism is mounted for oscillation about the first axis of oscillation by the pivot bearings.

7. The dry shaving apparatus as claimed in claim 6, wherein the housing includes a said support element and the electric drive mechanism has a housing portion and wherein at least one of the pivot bearings is provided on the support element of the housing and on the housing portion of the electric drive mechanism.

8. The dry shaving apparatus as claimed in claim 6, wherein the housing includes a support element and the electric drive mechanism comprises support arms, an oscillatory frame supported by the support arms, a universal joint frame mounted for oscillation in said oscillatory frame, and a bearing cage mounted for oscillation in said universal joint frame, wherein at least some of the pivot bearings are provided on the bearing cage of the electric drive mechanism and on the universal joint frame, and at least some of the pivot bearings are also provided on the universal joint frame and on the support element of the housing.

9. The dry shaving apparatus as claimed in claim 6, wherein the pivot bearings are configured as cone bearings.

10. The dry shaving apparatus as claimed in claim 1, wherein the electric drive mechanism comprises an oscillating element by which the shaving head is mounted for oscillation in the housing.

11. The dry shaving apparatus as claimed in claim 10, wherein the oscillating element comprises support arms having joints.

12. The dry shaving apparatus as claimed in claim 10, wherein the drive mechanism includes the housing portion and the oscillating element is formed by the housing portion of the drive mechanism.

13. The dry shaving apparatus as claimed in claim 10, wherein the oscillating element, comprises support arms, an oscillatory frame supported by the support arms, a universal joint frame mounted for oscillation in said oscillatory frame, and a bearing cage mounted for oscillation in said universal joint frame.

14. The dry shaving apparatus as claimed in claim 13, further comprising an oscillatory supporting frame, wherein the drive mechanism includes a housing portion and wherein the oscillating element is adapted to be linked to the oscillatory supporting frame through one of the bearing cage and the housing portion.

15. The dry shaving apparatus as claimed in claim 14, further comprising an engaging device linking one of the bearing cage and the housing portion to the supporting frame.

16. The dry shaving apparatus as claimed in claim 13, wherein the electric drive mechanism has a housing portion that is securable in the bearing cage.

17. The dry shaving apparatus as claimed in claim 1, wherein the shaving head is drivable by oscillatory motions of the electric drive mechanism in same directions of movement as the reciprocating cutting element.

18. The dry shaving apparatus as claimed in claim 17, wherein the shaving head is driven by the electric drive mechanism so as to oscillate in opposition to reciprocating movements of the reciprocating cutting element.

19. The dry shaving apparatus as claimed in claim 17, wherein the shaving head is drivable by the oscillatory motions of the electric drive mechanism in directions of movement that are transverse to the same directions of movement of the reciprocating cutting element.

20. The dry shaving apparatus as claimed in claim 19, wherein a reciprocatory travel of the shaving head in the same directions of movement of the reciprocating cutting element and in the directions of movement transverse thereto is in a range from 0.05 mm to 1 mm.

21. The dry shaving apparatus as claimed in claim 20, wherein the reciprocatory travel of the shaving head is in a range from 0.15 mm to 0.5 mm.

22. The dry shaving apparatus as claimed in claim 1, wherein different oscillation amplitudes are provided for the shaving head and the reciprocating cutting element.

23. The dry shaving apparatus as claimed in claim 22, wherein the oscillation amplitudes of at least one of the shaving head and the reciprocating cutting element are variable.

24. The dry shaving apparatus as claimed in claim 23, wherein the oscillation amplitude of the shaving head is variable by varying an oscillating mass of at least one of the shaving head and the electric drive mechanism.

25. The dry shaving apparatus as claimed in claim 23 or 24, further comprising a balance weight, wherein the oscillating mass of at least one of the shaving head and the electric drive mechanism is variable by an attachment of the balance weight thereto.

26. The dry shaving apparatus as claimed in claim 1, wherein an oscillation amplitude is determinable by the reciprocating cutting element, and an oscillation amplitude of the shaving head is adjustable thereto.

27. The dry shaving apparatus as claimed in claim 1, wherein the electric drive mechanism comprises a support arm is provided for supporting the shaving head.

28. The dry shaving apparatus as claimed in claim 30, wherein the support arm includes at least two joints.

29. The dry shaving apparatus as claimed in claim 28, wherein at least one of the at least two joins is configured as a film hinge.

30. The dry shaving apparatus as claimed in claim 27, wherein the support arm is configured as a spring element.

31. The dry shaving apparatus as claimed in claim 30, wherein the spring element is formed by a leaf spring.

32. The dry shaving apparatus as claimed in an claim 27, wherein the electric drive mechanism includes an oscillating element having joints and wherein the support arm is linked through the oscillating element to the electric drive mechanism.

33. The dry shaving apparatus as claimed in claim 28, wherein the housing includes a support element and the shaving head includes a shaving head frame and wherein the support arm is linked through one of said at least two joints to the support element, and through another one of said at least two joints to the shaving head frame of the shaving head, such as to enable the shaving head to oscillate in the first direction.

34. The dry shaving apparatus as claimed in claim 33, wherein said at least two joints for the support arm are provided in the housing at an end of the housing that is opposite to the shaving head.

35. The dry shaving apparatus as claimed in claim 34, wherein the support arm is linked for oscillation to the support element at one end and to a supporting frame carrying the shaving head (6) at another end.

36. The dry shaving apparatus as claimed in claim 1, further comprising a supporting frame adapted to be linked to the electric drive mechanism.

37. The dry shaving apparatus as claimed in claim 36, further comprising an engaging device, wherein the electric drive mechanism has a housing portion and further comprises support arms, an oscillatory frame supported by the support arms, a universal joint frame mounted for oscillation in said oscillatory frame, and a bearing cage mounted for oscillation in said universal joint frame and wherein the electric drive mechanism is adapted to be linked to the supporting frame through the housing portion, the bearing cage and the engaging device.

38. The dry shaving apparatus as claimed in claim 37, wherein the engaging device is formed of a slot and a pin engageable in said slot.

39. The dry shaving apparatus as claimed in claim 37, wherein the engaging device is formed of a ball-and-socket joint.

40. The dry shaving apparatus as claimed in claim 36, wherein the housing includes support arms and an oscillatory frame mounted for oscillation by the support arms on the housing and is adapted to be linked to the supporting frame by means of support arms.

41. The dry shaving apparatus as claimed in claim 1, further comprising an oscillatory bridge structure, wherein the drive element of the electric drive mechanism is linked to the reciprocating cutting element through said oscillatory bridge structure.

42. The dry shaving apparatus as claimed in claim 1, further comprising an eccentric device, wherein the drive element of the electric drive mechanism is linked to the reciprocating cutting element through the eccentric device.

43. The dry shaving apparatus as claimed in claim 42, wherein the eccentric device is configured as a double eccentric device.

44. The dry shaving apparatus as claimed in claim 43, further comprising an oscillatory bridge structure, wherein the double eccentric device includes an eccentric member that is linked to the reciprocating cutting element through the oscillatory bridge structure.

45. The dry shaving apparatus as claimed in claim 1, wherein the electric drive mechanism comprises a direct-current motor in which the driving motion of the drive element is rotation.

46. The dry shaving apparatus as claimed in claim 1, wherein the electric drive mechanism comprises a rocking armature motor in which the drive element is an oscillatory drive element.

47. The dry shaving apparatus as claimed in claim 1, further comprising spring elements which hold the electric drive mechanism and the shaving head in a mid-position.

48. The dry shaving apparatus as claimed in claim 47, wherein each of the spring elements bears with one end against the electric drive mechanism and with the spring elements other end against the housing.

49. The dry shaving apparatus as claimed in claim 1, wherein the shaving head and the electric drive mechanism are mounted for oscillation as an oscillating mass about a first and a second axis of oscillation.

50. The dry shaving apparatus as claimed in claim 49, further comprising a cardanic suspension by which the shaving head and the electric drive mechanism are mounted for oscillation in the housing about the first and the second axis of oscillation.

51. The dry shaving apparatus as claimed in claim 49, wherein the first and second axis of oscillation are arranged to extend through a center of impact of the oscillating mass.

52. The dry shaving apparatus as claimed in claim 49, wherein the first and the second axis of oscillation are arranged to extend at a distance from a center of impact of the oscillating mass.

* * * * *